US009875687B2

(12) United States Patent
Han et al.

(10) Patent No.: US 9,875,687 B2
(45) Date of Patent: Jan. 23, 2018

(54) DISPLAY DEVICE HAVING COMPENSATION CIRCUIT AND DRIVING METHOD THEREOF

(71) Applicant: Samsung Display Co., Ltd., Yongin (KR)

(72) Inventors: Sang-Myeon Han, Yongin (KR); Baek-Woon Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 136 days.

(21) Appl. No.: 14/816,910

(22) Filed: Aug. 3, 2015

(65) Prior Publication Data

US 2016/0098952 A1 Apr. 7, 2016

(30) Foreign Application Priority Data

Oct. 6, 2014 (KR) ..... 10-2014-0134301

(51) Int. Cl.
*G09G 3/32* (2016.01)
*G09G 3/3225* (2016.01)

(52) U.S. Cl.
CPC ..... *G09G 3/3225* (2013.01); *G09G 2320/029* (2013.01); *G09G 2320/0233* (2013.01);
(Continued)

(58) Field of Classification Search
CPC ... G09G 2320/0233; G09G 2320/0285; G09G 2360/16; G09G 2320/029; G09G 2320/043; G09G 2320/045
See application file for complete search history.

(56) References Cited

U.S. PATENT DOCUMENTS 7,538,306 B2 * 5/2009 Hente ..... G09G 3/3208 250/205
8,077,123 B2 * 12/2011 Naugler, Jr. ..... G09G 3/3233 315/169.3

(Continued)

FOREIGN PATENT DOCUMENTS

KR 10-2011-0076652 7/2011
KR 10-2011-0085399 7/2011

*Primary Examiner* — Benjamin C Lee
*Assistant Examiner* — Xuemei Zheng
(74) *Attorney, Agent, or Firm* — H.C. Park & Associates, PLC

(57) ABSTRACT

Exemplary embodiments of the present invention disclose a display device, and a method of driving the same. The display device includes a display unit including pixels included in one or more deterioration region groups and pixels included in one or more reference groups corresponding to the deterioration region groups, a sensing unit configured to sense a current flowing through an organic light emitting diode of each of the deterioration region groups and each of the reference groups and provide current information about the deterioration region group and current information about the reference group. Exemplary embodiments of the present invention also provide a compensation circuit configured to convert first data supplied from the outside into second data by using compensation data corresponding to a compensation prediction curve and output the second data, and compare the current information about the deterioration region group and the current information about the reference group and correct the compensation prediction curve for the deterioration region group; and a data driver configured to supply the second data to the display unit through data lines as data signals.

17 Claims, 4 Drawing Sheets

(52) U.S. Cl.
CPC ..... *G09G 2320/0285* (2013.01); *G09G 2320/043* (2013.01); *G09G 2320/045* (2013.01); *G09G 2360/16* (2013.01)

(56) References Cited

U.S. PATENT DOCUMENTS

| | | | | |
|---|---|---|---|---|
| 8,207,914 | B2 | 6/2012 | Cok et al. | |
| 2008/0210847 | A1* | 9/2008 | Hente | G09G 3/3208 250/205 |
| 2008/0231558 | A1* | 9/2008 | Naugler | G09G 3/3233 345/76 |
| 2011/0069061 | A1* | 3/2011 | Nakamura | G09G 3/3225 345/214 |
| 2011/0191042 | A1 | 8/2011 | Chaji et al. | |

* cited by examiner

DISPLAY DEVICE HAVING COMPENSATION CIRCUIT AND DRIVING METHOD THEREOF

CROSS-REFERENCE TO RELATED APPLICATION

This application claims priority to and the benefit of Korean Patent Application No. 10-2014-0134301, filed on Oct. 6, 2014, which is hereby incorporated by reference for all purposes as if fully set forth herein.

BACKGROUND OF THE INVENTION

Field of the Invention

Exemplary embodiments of the present invention relate to a display device and a driving method thereof, and to a display device, which is capable of accurately compensating for deterioration of pixels, and a driving method thereof.

Discussion of the Background

Various flat panel display devices capable of decreasing weight and volume have been developed. The flat panel display device may include a liquid crystal display device, a field emission display device, a plasma display panel, and/or an organic light emitting display device.

The organic light emitting display device among the flat panel display devices displays an image by using an Organic Light Emitting Diode (OLED) which generates light by a re-combination of electrons and holes. The organic light emitting display device may have a high response speed and may be driven with low power consumption.

However, the OLED and a transistor included in a pixel gradually deteriorate by use over time. Such gradual deterioration eventually deviate brightness between pixels. Such brightness deviation may generate brightness bruising in the organic light emitting display device, which may degrade an image quality.

In order to compensate for brightness deviations between the pixels due to deterioration, various methods have been studied. For example, a method of compensating for image data according to an accumulation value obtained by accumulating a pixel value supplied to each of the pixels has been known in the art.

According to the method, a compensation value for each of the pixels is calculated by substituting an accumulation value of each of the pixels to a predefined lifespan model formula of the pixel. However, the lifespan model formula of the pixel is a formula calculated by generally reflecting a characteristic of a panel, and when a lifespan characteristic is different between the panels or in each pixel within the panel, a parameter of the lifespan model formula of the pixel does not correspond to a parameter of an actual pixel, and it is not properly compensated.

SUMMARY OF THE INVENTION

The present invention has been made in an effort to solve the above-described problems associated with the prior art, and provides a display device, which is capable of accurately compensating for deterioration of pixels, and a driving method thereof.

Exemplary embodiments of the present invention provide a display device, including a display unit comprising pixels included in at least one or more deterioration region groups and pixels included in at least one or more reference groups corresponding to the deterioration region groups, a sensing unit configured to sense a current flowing through an organic light emitting diode of each of the deterioration region groups and each of the reference groups and provide current information of the deterioration region group and current information of the reference group. The exemplary embodiments further provide a compensation circuit configured to convert first data to second data by using compensation data corresponding to a compensation prediction curve and provide the second data, and compare the current information of the deterioration region group and the current information of the reference group and correct the compensation prediction curve for the deterioration region group, and a data driver configured to supply the second data to the display unit.

Exemplary embodiments of the present invention also disclose a method of driving a display device, including storing accumulated data obtained by accumulating display data corresponding to a plurality of pixels during a display operation, setting the plurality of pixels into a plurality of deterioration region groups by using the accumulated data in a compensation setting mode, setting the remaining pixels, among the plurality of pixels into a plurality of reference groups, which correspond to the plurality of deterioration region groups, respectively. Exemplary embodiments also disclose sensing current information of each of the plurality of deterioration region groups and current information of each of the plurality of reference groups, comparing the current information, and correcting a compensation prediction curve, generating group compensation data according to the corrected compensation prediction curve, and storing the generated group compensation data in the memory unit, and converting first data input during the display operation into second data by using the group compensation data.

Exemplary embodiments of the present invention also disclose method of driving a display device, including storing accumulated data obtained by accumulating display data corresponding to a plurality of pixels during a display operation, setting the plurality of pixels into a plurality of deterioration region groups by using the accumulated data when a compensation setting mode is performed during the display operation, setting the remaining pixels into a reference group. Exemplary embodiments further disclose sensing current information of each of the plurality of deterioration region groups and current information of the reference group, comparing the amount of current sensed and updating compensation data for each pixel, and converting first data input during the display operation into second data by using the compensation data for each pixel.

It is to be understood that both the foregoing general description and the following detailed description are exemplary and explanatory and are intended to provide further explanation of the invention as claimed.

BRIEF DESCRIPTION OF THE DRAWINGS

Exemplary embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

DETAILED DESCRIPTION OF THE INVENTION

Figure 1:
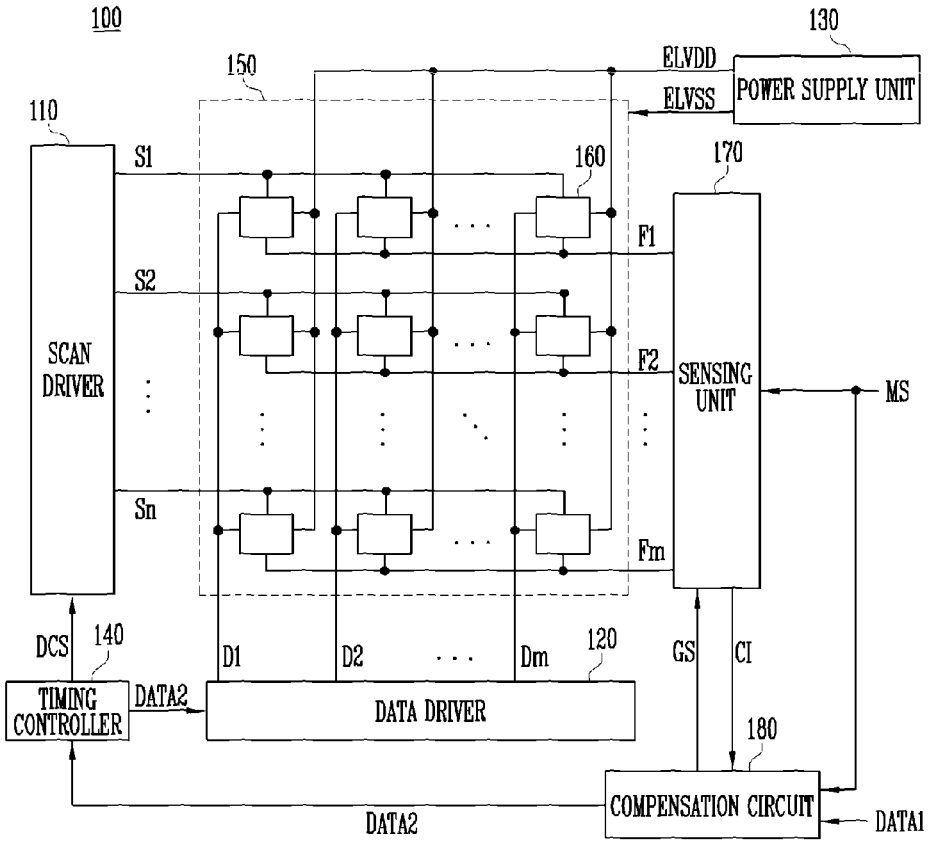
FIG. 1 is a block diagram illustrating a display device according to exemplary embodiments of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. It may also be understood that for the purposes of this disclosure, "at least one of X, Y, and Z" can be construed as X only, Y only, Z only, or any combination of two or more items X, Y, and Z (e.g., XYZ, XYY, YZ, ZZ).

FIG. 1 is a block diagram illustrating a display device according to exemplary embodiments of the present invention.

Referring to FIG. 1, a display device 100 may include a scan driver 110, a data driver 120, a power supply unit 130, a timing controller 140, a display unit 150, a sensing unit 170, and a compensation circuit 180.

The scan driver 110 may sequentially supply a scan signal to scan lines S1 to Sn in response to a scan driving control signal SCS output from the timing controller 140.

The data driver 120 may realign second data DATA2 supplied from the timing controller 140 and may supply the second data DATA 2 to data lines D1 to Dm as data signals in response to a data driving control signal DCS output from the timing controller 140.

The power supply unit 130 may generate first pixel power source (ELVDD) and second pixel power source (ELVSS) by using an external power source and supply them to the display unit 150.

The timing controller 140 may control operations of the data driver 120 and the scan driver 110 in response to a synchronization signal (not illustrated) supplied from outside. The timing controller 140 may generate the data driving control signal DCS and supply it to the data driver 130. The timing controller 120 may generate the scan driving control signal SCS and may supply it to the scan driver 140. The timing controller 140 may supply second image data DATA 2 received from the compensation circuit 180 to the data driver 120.

The display unit 150 may include pixels 160 arranged at crossing parts of data lines D1 to Dm, feedback lines F1 to Fm, and scan lines S1 to Sn. The data lines D1 to Dm and the feedback lines F1 to Fm may be arranged along a first direction, and the scan lines S1 to Sn may be arranged along a second direction, which crosses the first direction.

When a scan signal is supplied through a corresponding scan line among the scan lines S1 to Sn, each of the pixels 160 may emit light with brightness corresponding to a data signal supplied through a corresponding data line among the data lines D1 to Dm.

The sensing unit 170 may sense currents supplied from the pixels 160 included in a defined deterioration region group and reference group in response to a mode signal MS activated in a compensation setting mode and group setting information GS output from the compensation circuit 180, and may supply current information CI corresponding to the sensed current values to the compensation circuit 180. The sensing unit 170 may be connected to the pixels 160 and the feedback line F1 to Fm in order to sense currents supplied from the pixels 160. The sensing unit 170 may measure a current value by measuring a difference in potential between the currents supplied from the pixels 160 by using measurement resistance. The sensing unit 170 may be configured by a hall sensing method to measure a current value.

The compensation circuit 180 may receive current information CI from the sensing unit 170 in response to the mode signal MS activated in the compensation setting mode, may determine the amount of deterioration of each pixel by using the received current information CI, may group the plurality of pixels into several groups according to a result of the determination, and may define the deterioration region groups. The compensation circuit 180 may compare a deterioration degree of each deterioration region groups with a deterioration degree of the reference group, and may correct and update a deterioration compensation value corresponding to each deterioration region group. The compensation circuit 180 may compare a deterioration degree of each pixel and a deterioration degree of the reference group, instead of grouping the plurality of pixels, and may correct and update a deterioration compensation value corresponding to each pixel.

Figure 2:
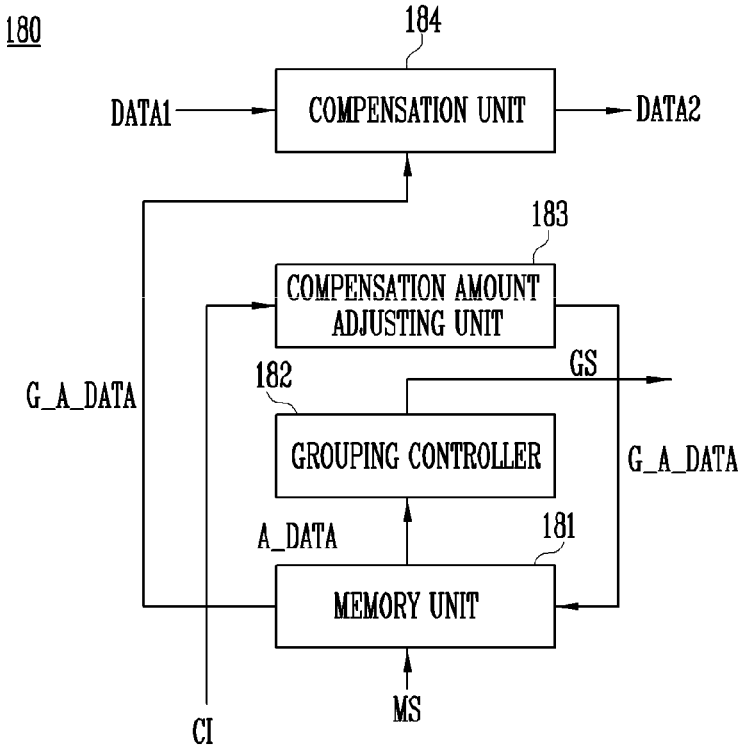
FIG. 2 is a block diagram illustrating a compensation circuit illustrated in FIG. 1.

FIG. 2 is a block diagram illustrating a compensation circuit illustrated in FIG. 1.

Referring to FIG. 2, the compensation circuit 180 may include a memory unit 181, a grouping controller 182, a compensation amount adjusting unit 183, and a compensation unit 184.

Accumulated data A_DATA for each pixel may be stored in the memory unit 181 during a display operation. The memory unit 181 may output the stored accumulated data A_DATA for each pixel in response to the mode signal MS in the compensation setting mode. The memory unit 181 may update compensation data G_A_DATA for each group, which may be set for each deterioration region group by the compensation amount adjusting unit 183, or the accumulated data A_DATA for each pixel by using compensation data for each pixel in the compensation setting mode.

The grouping controller 182 may read the accumulated data A_DATA for each pixel stored in the memory unit in the compensation setting mode, may group adjacent pixels having the similar amount of deterioration according to the read accumulated data A_DATA for each pixel, and may define a plurality of deterioration region groups. Further, a global deterioration region and the reference group may be set within the global deterioration region. The global deterioration region may be formed of pixels, which may be adjacent to each other and may have deterioration degrees close to a reference value, among the remaining pixels except for the deterioration region group. The reference group may be set by selecting pixels within the global deterioration region so that the number of pixels of the reference group may be the same as that of each deterioration region group. The grouping controller 182 may set the deterioration region group and the reference group, and may then output the group setting information GS to the sensing unit 170.

The compensation amount adjusting unit 183 may compare current information CI of each deterioration region group and current information CI of the reference group, may adjust a compensation amount of each deterioration region group according to a result of the comparison, and may generate compensation data G_A_DATA for each group. The generated compensation data G_A_DATA for each group may be stored in the memory unit 181.

The compensation unit 184 may convert the first image data DATA1 into second image data DATA2 according to the compensation data G_A_DATA for each group stored in the memory unit 181, and may supply the second image data DATA2 to the timing controller 140 illustrated in FIG. 1.

Figure 3:
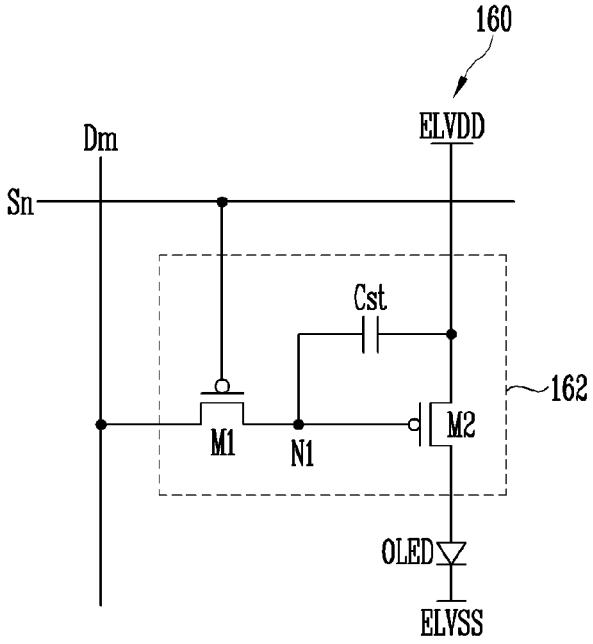
FIG. 3 is a detailed circuit diagram of a pixel illustrated in FIG. 1.

FIG. 3 is a detailed circuit diagram of the pixel illustrated in FIG. 1.

Referring to FIG. 3, a pixel 160 may include an organic light emitting diode OLED, a scan line Sn, a data line Dm, a first pixel power source ELVDD, and a pixel circuit 162 connected to the organic light emitting diode OLED.

An anode electrode of the organic light emitting diode OLED may be connected to the pixel circuit 162, and a cathode electrode of the organic light emitting diode OLED may be connected to a second pixel power source ELVSS. The organic light emitting diode OLED may emit light with predetermined luminance in response to a current amount supplied from the pixel circuit 162.

The pixel circuit 162 may include a first transistor M1, a second transistor M2, and a storage capacitor Cst.

A first electrode of the first transistor M1 may be connected to the data line Dm, and a second electrode may be connected to a first node N1. A gate electrode of the first transistor M1 may be connected to the scan line Sn. The first transistor M1 may be turned on when the scan signal is supplied through the scan line Sn to transmit a data signal supplied through the data line Dm to the first node N1.

A first electrode of the second transistor M2 may be connected to the first pixel power source ELVDD, and a second electrode may be connected to the anode electrode of the organic light emitting diode OLED. A gate electrode of the second transistor M2 may be connected to the first node N2. The second transistor M2 may control a current flowing from the first pixel power source ELVDD to the anode electrode of the organic light emitting diode OLED in response to a voltage supplied to the gate electrode.

One terminal of the storage capacitor Cst may be connected to the first node N1, and the other terminal of the storage capacitor Cst may be connected to the first pixel power source ELVDD and the first electrode of the second transistor M2. The storage capacitor Cst may store a voltage corresponding to the data signal supplied to the first node N1 when the scan signal is supplied to the scan line Sn, and may maintain the stored voltage for one frame.

An operation process of the pixel 160 will be described in detail. When a scan signal is supplied to the scan line Sn, the first transistor M1 may be turned on. When the first transistor M1 is turned on, the data signal supplied through the data line Dm may be transmitted to the first node N1 via the first transistor M1. When the data signal is transmitted to the first node N1, a voltage corresponding to a difference between a voltage of the first pixel power source ELVDD and the data signal may be charged in the storage capacitor Cst. The second transistor M2 may control a current flowing from the first pixel power source ELVDD to the organic light emitting diode OLED in response to the voltage supplied to the gate electrode. Accordingly, the organic light emitting diode OLED may emit light in response to the current amount supplied to display an image.

As described above, the pixel 160 may emit light with luminance corresponding to the current amount supplied from the second transistor M2. The voltage of the first node N1, to which the gate electrode of the second transistor M2 is connected, may be maintained for one frame by the storage capacitor Cst. However, the storage capacitor Cst may charge the voltage corresponding to the difference between the voltage of the first pixel power source ELVDD and the data signal during the supply of the data signal, and may maintain the charged voltage for one frame. Accordingly, emission luminance of the pixel 160 may vary according to the voltage of the first pixel power source ELVDD and the data signal.

In the compensation setting mode, the pixel 160 may emit light for each color, red, green, and blue (R, G, and B), and a current amount flowing through the organic light emitting diode OLED for each color may be sensed by the sensing unit 170 of FIG. 1.

Figure 4:
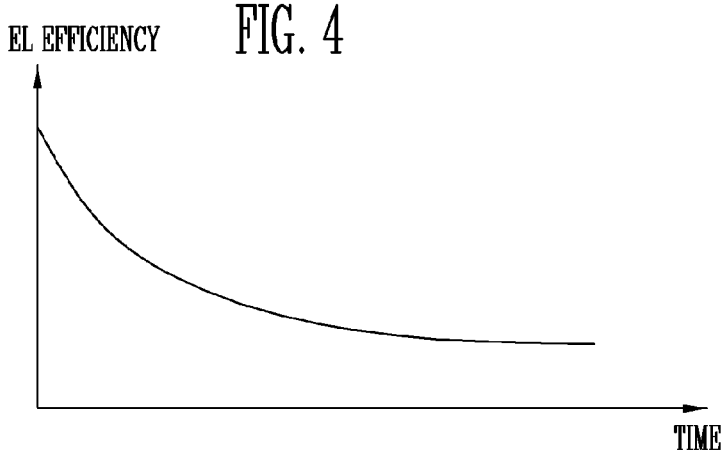
FIG. 4 is a graph illustrating a compensation prediction curve.

FIG. 4 is a graph illustrating a compensation prediction curve.

Referring to FIG. 4, light emission efficiency of the pixels of the display unit decreases as a display time increases. Accordingly, it may be possible to set compensation data by predicting a deterioration degree by using a compensation prediction curve.

Figure 5:
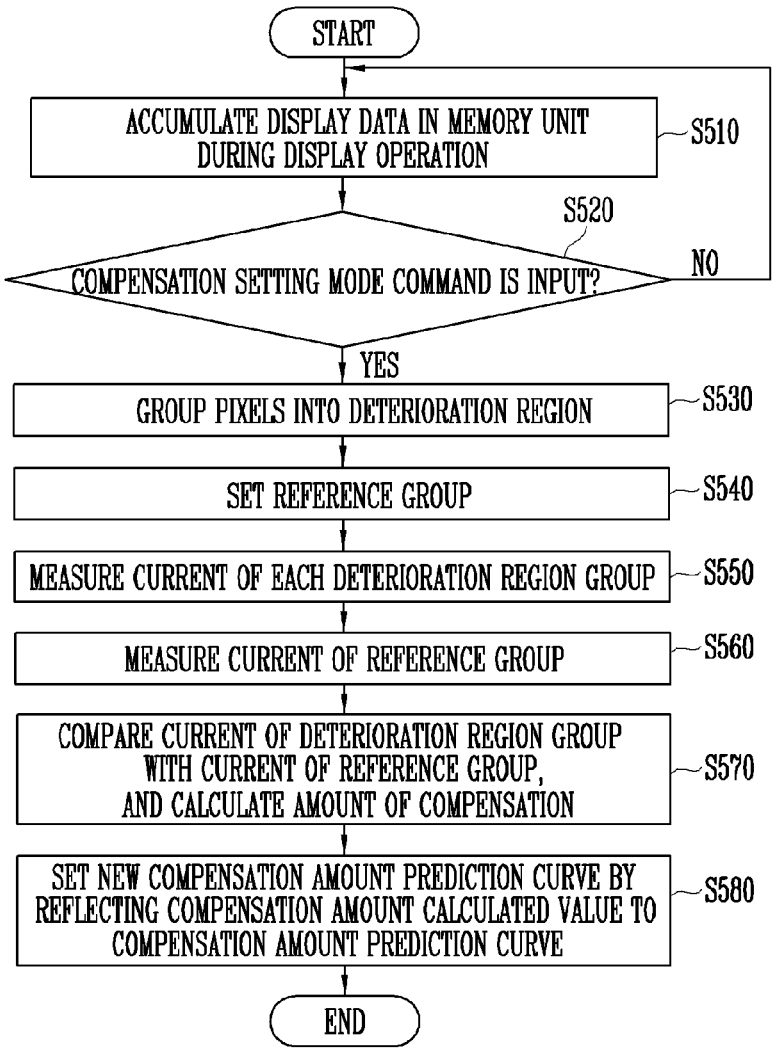
FIG. 5 is a flowchart for describing an operation of a display device according to one exemplary embodiment of the present invention.

FIG. 5 is a flowchart for describing an operation of a display device according to exemplary embodiments of the present invention.

An operation of the display device of the present invention will be described below with reference to FIG. 1, FIG. 2, FIG. 3, FIG. 4, and FIG. 5.

In step S510, first data DATA1 input from the outside may be converted into the second data DATA2 by the compensation circuit 180, and the second data DATA2 may be input into the timing controller 140. The timing controller 140 may control operations of the data driver 120 and the scan driver 110 in response to a synchronization signal (not illustrated) supplied from the outside. The timing controller 140 may generate the data driving control signal DCS and may supply it to the data driver 120. The timing controller 140 may generate a scan driving control signal SCS and may supply it to the scan driver 110. The timing controller 140 may also supply the second data DATA2 supplied from the compensation circuit 180 to the data driver 120. The data driver 120 may realign the second data DATA2 supplied from the timing controller 140 in response to the data driving control signal DCS output from the timing controller 140 and may supply the realigned second data DATA2 to the data lines D1 to Dm as data signals, and the scan driver 110 may sequentially supply the scan signal to the scan lines S1 to Sn and may drive the pixels 160 in response to the scan driving control signal SCS output from the timing controller 140 to perform a display operation.

In this case, the compensation circuit 180 may store in the memory unit 181 accumulated data of the accumulated first data DATA1 supplied from the outside.

Then, step S520 checks whether a compensation setting mode command is input from the outside during the display operation.

When the compensation setting mode command is input, in step S530, the mode signal MS may be input into the sensing unit 170 and the compensation circuit 180.

The compensation circuit 180 may output the accumulated data A_DATA for each pixel stored in the memory unit 181 to the grouping controller 182, and the grouping controller 182 may analyze the accumulated data A_DATA for each pixel and sets a plurality of deterioration region groups. In terms of the plurality of deterioration region groups, the pixels, which have a similar amount of deterioration and are adjacent to each other, may be set into one deterioration region group.

The grouping controller 182 may analyze the accumulated data A_DATA for each pixel and may set a global deterioration region. The pixels, which have the amount of deterioration close to a reference value, in the remaining pixel regions except for the plurality of deterioration region groups, may be set as the global deterioration region. A plurality of global deterioration regions may be set within the display unit 150. Reference groups having the same number of pixels as the number of pixels included in the plurality of deterioration region groups within the global deterioration region may be set in step S540. For example, one reference group corresponding to one deterioration region group may be set.

The grouping controller 182 may set the deterioration region group and the reference group, and may then output group setting information GS to the sensing unit 170.

The sensing unit 170 may divide the plurality of pixels 160 into a plurality of deterioration region groups and a plurality of reference groups according to the group setting information GS output from the grouping controller 182, and may measure the amount of current for each group in step S550. For example, the current sensing method may be simultaneously performed on the plurality of deterioration region groups, or may be sequentially performed for each of the plurality of deterioration region groups.

In a current amount measuring method for each group, the second transistor M2 included in the pixel 160 may be driven in a linear mode, and then the amount of current flowing through the organic light emitting diode OLED may be measured. For example, a value of Vgs of the second transistor M2 may be controlled to be greatest, and the first pixel power source ELVDD may be controlled to be 5 to 7V. It may be possible to improve accuracy in the measurement of the amount of current by performing a current amount measuring operation several times while varying the first pixel power source ELVDD. In the current amount measuring method, the amount of current may be measured by making the pixels included in each deterioration region group emit light for each R, G, and B.

In the current amount measuring method, when the amount of current is not large enough, the measurement operation may be performed by reversing a pattern of the deterioration region group and increasing the amount of current.

The current information CI based on the amount of current measured for each deterioration region group may be output to the compensation amount adjusting unit 183 of the compensation circuit 180.

In step S560, the sensing unit 170 may measure the amount of currents of the pixels included in the plurality of reference groups among the plurality of pixels 160 included in the display unit 150 according to the group setting information GS output from the grouping controller 182. For example, a method of measuring the amount of current may be performed similar to the method of measuring the amount of current of the corresponding deterioration region group.

The current information CI based on the amount of current measured for each reference group may be output to the compensation amount adjusting unit 183 of the compensation circuit 180.

The aforementioned measuring of the current of the deterioration region group (S550) and measuring of the current of the reference group (S560) may be repeatedly performed several times as necessary, for improving accuracy in the current measurement.

The compensation amount adjusting unit 183 may calculate the amount of compensation by comparing the current information CI of the plurality of deterioration region groups and the current information CI of the reference groups corresponding to each of the plurality of deterioration region groups. For example, in comparing the current information CI, average values for each group may be compared with each other.

When it is determined that the amount of current of the selected deterioration region group is smaller than the amount of current of the reference group as a result of the comparison of the current information CI of the selected deterioration region group and the current information CI of the reference group corresponding to the selected deterioration region group, the amount of deterioration of the pixels included in the deterioration region group may be greater than the reference amount of deterioration. When the amount of current of the pixel of the selected deterioration region group is greater than the amount of current of the reference group, the amount of deterioration of the pixels included in the deterioration region group may be smaller than the reference amount of deterioration. In step S570, based on such comparison, the compensation amount may be calculated and increased to be greater, or decreased to be smaller, than a reference setting value to be newly set.

The compensation method may be divided into a global compensation method and a position-based compensation method, and then may correct and set a compensation amount prediction curve according to each method in step S580.

For example, the global compensation method, which may perform a compensation operation by applying one compensation prediction curve to one panel, may set a compensation prediction curve applied to an entire panel. Accordingly, the compensation prediction curve may be corrected by averaging compensation amount calculation values of the plurality of deterioration region groups.

The position-based compensation method, which may perform a compensation operation by applying different compensation prediction curves for the respective deterioration region groups, may correct each compensation prediction curve by using the compensation amount calculation value for each of the deterioration region groups.

Information on the corrected compensation prediction curve may be stored in the memory unit 181 as compensation data G_A_DATA for each group.

In a display mode, the compensation unit 184 may convert the first data DATA1 input from the outside into the second data DATA2 by using the compensation data G_A_DATA for each group and output the second data DATA2.

The aforementioned method of setting the compensation data G_A_DATA for each group in the compensation setting mode may be repeatedly performed for a predetermined number of times, to improve accuracy.

Figure 6:
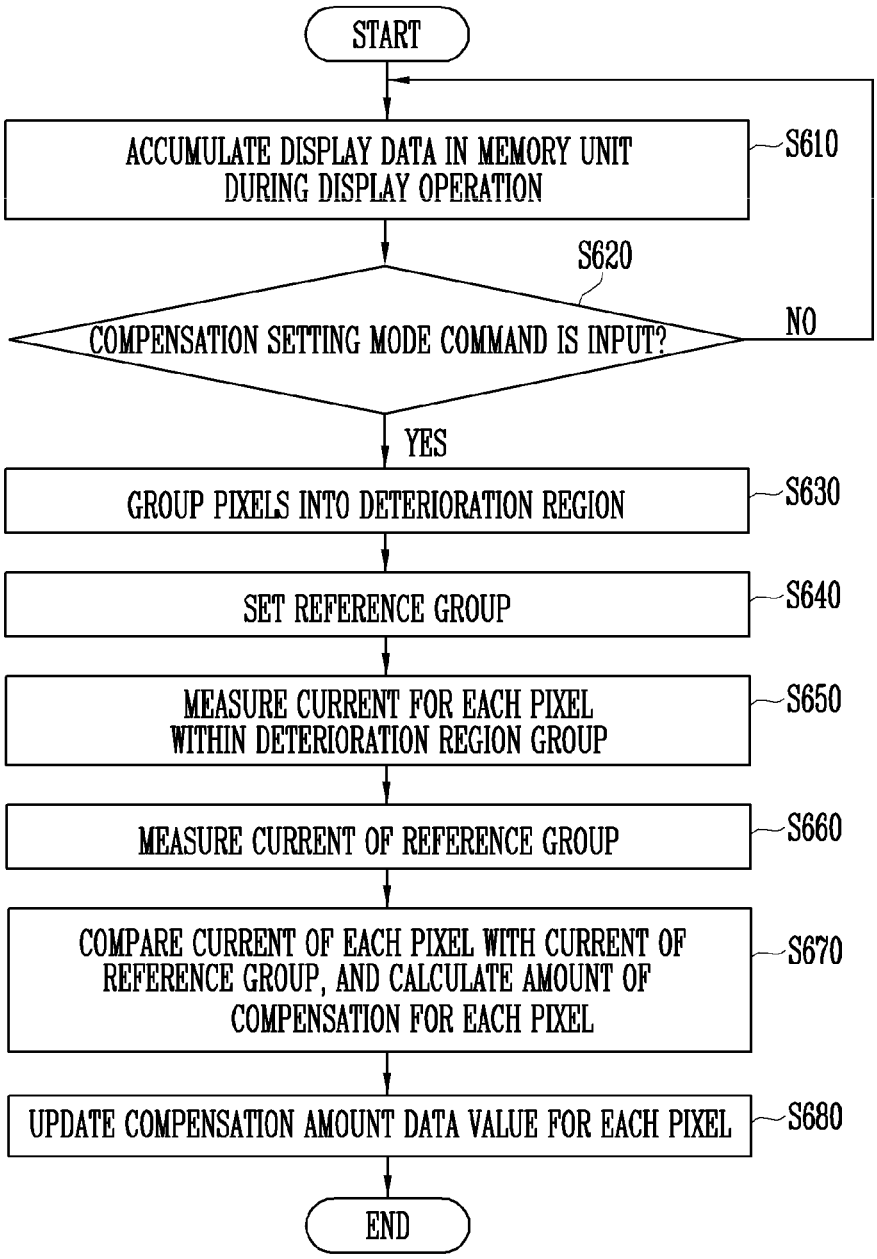
FIG. 6 is a flowchart for describing an operation of a display device according to another exemplary embodiment of the present invention.

FIG. 6 is a flowchart for describing an operation of a display device according to exemplary embodiments of the present invention.

Steps from S610 through S640 are substantially similar to steps from steps S510 through S540. Therefore, similar explanations are not repeated.

In step S650, the sensing unit 170 may divide the plurality of pixels 160 into a plurality of deterioration region groups and a plurality of reference groups according to the group setting information GS output from the grouping controller 182, and may measure the amount of current for each group. When the amount of current is measured for each group, the amount of current of each of the entire pixels may be included in each deterioration region group. Accordingly, the current sensing method may be simultaneously performed on the plurality of deterioration region groups, or sequentially performed for each of the plurality of deterioration region groups.

In a current amount measuring method for each group, the second transistor M2 included in the pixel 160 may be driven in a linear mode, and subsequently the amount of current flowing through the organic light emitting diode OLED may be measured. Accordingly, a value of Vgs of the second transistor M2 may be controlled to be greatest, and the first pixel power source ELVDD may be controlled to be 5 to 7V. It may be possible to improve accuracy in the measurement of the amount of current by performing a current amount measuring operation several times while varying the first pixel power source ELVDD. In the current amount measuring method, the amount of current may be measured by making the pixels included in each deterioration region group emit light for each R, G, and B.

In the current amount measuring method, when the amount of current is not great, the measurement operation may be performed by reversing a pattern of the deterioration region group and increasing the amount of current.

The current information CI based on the amount of current measured for each deterioration region group may be output to the compensation amount adjusting unit 183 of the compensation circuit 180.

In step S660, the sensing unit 170 may measure the amount of currents of the pixels included in the plurality of reference groups among the plurality of pixels 160 included in the display unit 150 according to the group setting information GS output from the grouping controller 182. Accordingly, a method of measuring the amount of current may be performed similar to the method of measuring the amount of current of the corresponding deterioration region group.

The current information CI based on the amount of current measured for each reference group may be output to the compensation amount adjusting unit 183 of the compensation circuit 180.

The aforementioned measuring of the current for each pixel within the deterioration region group (S650) and measuring of the current of each reference group (S660) may be repeatedly performed several times as necessary, for improving accuracy in the measurement of the current.

The compensation amount adjusting unit 183 may calculate the amount of compensation by comparing the current information CI of the plurality of deterioration region groups and the current information CI of the reference group. For example, the current information CI may be compared by comparing the amount of current of each pixel included in each deterioration region group and the average amount of current of the reference group.

When it is determined that the amount of current of the selected deterioration region group is smaller than the average amount of current of the reference group as a result of the comparison of the current information CI of the selected deterioration region group and the current information CI of the reference group corresponding to the selected deterioration region group, the amount of deterioration of the pixels included in the deterioration region group may be greater than the reference amount of deterioration. When the amount of current of the pixel of the selected deterioration region group is greater than the average amount of current of the reference group, the amount of deterioration of the pixels included in the selected deterioration region group may be smaller than the reference amount of deterioration, so that the amount of compensation may be increased to be greater, or decreased to be smaller, than a reference setting value to be newly set.

The compensation method may be divided into a global compensation method and a position-based compensation method, and may subsequently update a compensation amount data according to each method.

In step S680, when the compensation method is the global compensation method of performing a compensation operation by applying one compensation data value to one panel, a compensation data value of one deterioration region group among the plurality of deterioration region groups may be updated as a compensation data value of the pixels included in the entire panel.

When the compensation method is the position-based compensation method of performing a compensation operation by applying different compensation data for each deterioration region group, compensation amount data of each pixel included in each deterioration region group may be updated by using compensation amount data for each deterioration region group.

Information on the corrected compensation prediction curve may be stored in the memory unit 181 as compensation data G_A_DATA for each group.

In a display mode, the compensation unit 184 may convert first data DATA1 input from the outside into second data DATA2 by using the compensation data G_A_DATA for each group and outputs the second data DATA2.

The aforementioned method of setting the compensation data G_A_DATA for each group in the compensation setting mode may be repeatedly performed for the predetermined number of times, to improve accuracy.

As described above, the display device 100 and the driving method may perform a more accurate compensation operation by grouping pixels of a display unit into a plurality of deterioration region groups in a compensation setting mode, comparing each group with a reference group, and correcting a compensation prediction curve corresponding to each group. It may be possible to improve accuracy of a compensation operation by comparing the amount of current of the pixels included in each deterioration region group and the amount of current of a pixel included in the reference group, and updating compensation amount data for each pixel according to a result of the comparison.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a display unit comprising pixels included in one or more deterioration region groups and pixels included in one or more reference groups corresponding to the deterioration region groups, the pixels included in the one or more deterioration region groups and the one or more reference groups displaying images;

a sensing circuit configured to sense a current flowing through an organic light emitting diode of the one or more deterioration region groups and a current flowing through an organic light emitting diode of the one or more reference groups and provide current information of the one or more deterioration region groups and current information of the one or more reference groups;

a compensation circuit configured to convert first data to second data corresponding to the one or more deterioration region groups by using compensation data corresponding to a compensation prediction curve and provide the second data, compare the current information of the one or more deterioration region groups and the current information of the corresponding one or more reference groups, and correct the compensation prediction curve for the one or more deterioration region groups according to the comparing of the current information; and a data driver configured to supply the second data to the display unit, wherein the compensation circuit includes:

a memory unit configured to store accumulated data each corresponding to one of the plurality of pixels included in the display unit and group compensation data corresponding to the one or more deterioration region groups;

a grouping controller configured to group the plurality of pixels into the one or more deterioration region groups according to the accumulated data;

a compensation amount adjusting circuit configured to compare the current information of the one or more deterioration region groups and the current information of the corresponding one or more reference groups, calculate an amount of compensation for each of the one or more deterioration region groups, and generate the group compensation data according to the calculated values of amount of compensation for each of the one or more deterioration region groups, wherein the compensation circuit configured to convert the first data into the second data according to the group compensation data.

2. The display device of claim 1, wherein the sensing circuit is connected with the pixels included in the display unit, and measures potential difference using currents supplied from the pixels and measures the amount of currents of the pixels included in the one or more deterioration region groups and the amount of currents of the pixels included in the one or more reference groups.

3. The display device of claim 1, wherein the sensing circuit measures the amount of currents of the pixels included in the one or more deterioration region groups and the amount of currents of the pixels included in the one or more reference groups.

4. The display device of claim 1, wherein the grouping controller groups pixels, which have the similar amount of deterioration and are adjacent to each other, among the plurality of pixels into the one or more deterioration region groups according to the accumulated data, and sets the one or more reference groups corresponding to the one or more deterioration region groups, in which the number of pixels of the one or more deterioration region groups is the same as the number of pixels of the one or more reference groups corresponding to the one or more deterioration region groups.

5. The display device of claim 1, wherein the compensation amount adjusting circuit compares the amount of currents of the pixels included in the one or more deterioration region groups and the amount of currents of the pixels included in the corresponding one or more reference groups, and corrects the compensation prediction curve so that the amount of currents of the pixels included in the one or more deterioration region groups is close to the amount of currents of the pixels included in the corresponding one or more reference groups according to a result of the comparison.

6. The display device of claim 1, wherein the compensation amount adjusting circuit corrects the compensation prediction curve by averaging calculated values of amount of the compensation for each of the one or more deterioration region groups when a data compensation method is a global compensation method, and the compensation amount adjusting circuit corrects each compensation prediction curve for each of the one or more deterioration region group by a calculated amount of compensation for each of the one or more deterioration region groups when the data compensation method is a position-based compensation method.

7. The display device of claim 1, wherein the compensation amount adjusting circuit compares current information of each of the pixels included in the one or more deterioration region groups and current information of the pixels included in the corresponding one or more reference groups, calculates an amount of compensation for each pixel, and generates compensation data for each pixel.

8. A method of driving a display device, comprising:

storing accumulated data each obtained by accumulating display data corresponding to each of a plurality of pixels during a display operation;

setting a group among the plurality of pixels into a plurality of deterioration region groups by using the accumulated data in a compensation setting mode;

setting another group of pixels among the remainder of the plurality of pixels into a plurality of reference groups that correspond to the plurality of deterioration region groups respectively;

sensing current information of each of the plurality of deterioration region groups and current information of each of the plurality of reference groups, comparing the current information, and correcting a compensation prediction curve according to the comparing of the current information;

generating group compensation data corresponding to each of the plurality of deterioration region groups according to the corrected compensation prediction curve, and storing the generated group compensation data in a memory unit; and converting first data input during the display operation into second data by using the group compensation data for the plurality of the deterioration region groups, wherein pixels of the plurality of deterioration region groups and pixels of the plurality of reference groups display images corresponding to the display data during the display operation.

9. The method of claim 8, wherein the plurality of deterioration region groups is set by grouping a group of pixels among the plurality of pixels that have a similar deterioration degree and are adjacent to each other, into one deterioration region group.

10. The method of claim 8, wherein the number of pixels included in one of the plurality of reference groups is the same as the number of pixels included in the corresponding deterioration region group among the plurality of deterioration region groups.

11. The method of claim 8, wherein step of correcting the compensation prediction curve further comprises:

comparing an amount of currents of the pixels included in each of the plurality of deterioration region groups and an amount of currents of the pixels included in corresponding one of the plurality of reference groups; and correcting the compensation prediction curve so that the amount of currents of the pixels included in one of the plurality of deterioration region groups is similar to the amount of currents of the pixels included in corresponding one of the plurality of reference groups.

12. The method of claim 8, wherein step of correcting the compensation prediction curve further comprises:

correcting the compensation prediction curve by averaging the group compensation data for each of the plurality of deterioration region groups when a data compensation method is a global compensation method; and correcting a compensation prediction curve corresponding to each of the plurality of deterioration region groups by using the group compensation data for each deterioration region group when the data compensation method is a position-based compensation method.

13. The method of claim 8, wherein step of sensing the current information of each of the plurality of deterioration region groups and each of the plurality of reference groups comprises:

making pixels included in each of the plurality of deterioration region groups and each of the plurality of reference groups emit light for each color, Red (R), Green (G), and Blue (B); and sensing the amount of current flowing through an organic light emitting diode included in the pixels for each color.

14. A method of driving a display device, comprising:

storing accumulated data each obtained by accumulating display data corresponding to each of a plurality of pixels during a display operation;

setting a group of pixels among the plurality of pixels into a plurality of deterioration region groups by using the accumulated data when a compensation setting mode is performed during the display operation;

setting another group of pixels among the remainder of the plurality of pixels into a reference group;

sensing current information of each of the plurality of deterioration region groups and current information of the reference group, comparing the amount of current information, and updating compensation data based on the comparing of the current information for each pixel; and converting first data input during the display operation into second data by using the compensation data for each pixel in the plurality of the deterioration region groups, wherein pixels of the plurality of deterioration region groups and pixels of the plurality of reference groups display images corresponding to the display data during the display operation.

15. The method of claim 14, wherein the plurality of deterioration region groups is set by grouping a group of pixels among the plurality of pixels that have a similar deterioration degree and are adjacent to each other, into one deterioration region group.

16. The method of claim 14, wherein step of comparing the amount of currents sensed comprises:

comparing the amount of current of each of the plurality of pixels included in the each of the plurality of deterioration region groups and an average amount of currents of the pixels included in the reference group.

17. The method of claim 14, wherein step of sensing the current information of each of the plurality of deterioration region groups and each of the reference groups comprises:

making pixels included in each of the plurality of deterioration region groups and the reference group emit light for each color, Red (R), Green (G), and Blue (B); and sensing the amount of current flowing through an organic light emitting diode included in the pixels for each color.

* * * * *